US009528750B2

(12) United States Patent
Eckartsberg

(10) Patent No.: US 9,528,750 B2
(45) Date of Patent: Dec. 27, 2016

(54) REFRIGERATION DEVICE HAVING A SEAL ELEMENT IN THE FORM OF A HOLLOW PROFILE

(75) Inventor: Peter Eckartsberg, Aalen (DE)

(73) Assignee: BSH Hausgeräte GmbH, Munich (DE)

( * ) Notice: Subject to any disclaimer, the term of this patent is extended or adjusted under 35 U.S.C. 154(b) by 713 days.

(21) Appl. No.: 12/864,242

(22) PCT Filed: Jan. 19, 2009

(86) PCT No.: PCT/EP2009/050559
§ 371 (c)(1),
(2), (4) Date: Jul. 23, 2010

(87) PCT Pub. No.: WO2009/095329
PCT Pub. Date: Aug. 6, 2009

(65) Prior Publication Data

US 2010/0307065 A1 Dec. 9, 2010

(30) Foreign Application Priority Data

Feb. 1, 2008 (DE) ..... 10 2008 007 244

(51) Int. Cl.

| | |
|---|---|
| ***A47B 95/00*** | (2006.01) |
| ***A47B 96/00*** | (2006.01) |
| ***F25D 23/08*** | (2006.01) |
| *F25D 25/02* | (2006.01) |
| *F25D 11/02* | (2006.01) |

(Continued)

(52) U.S. Cl.
CPC ..... *F25D 23/087* (2013.01); *E06B 7/2318* (2013.01); *F25D 11/02* (2013.01); *F25D 23/025* (2013.01); *F25D 25/02* (2013.01)

(58) Field of Classification Search
USPC ..... 312/405, 296, 326–329, 109, 138.1; 277/630, 631, 644, 645, 647, 651, 921, 277/637; 49/475.1, 498.1, 492.1, 493.1, 478.1
See application file for complete search history.

(56) References Cited

U.S. PATENT DOCUMENTS 2,070,725 A * 2/1937 Gail ..... 49/493.1
2,102,578 A * 12/1937 Gail ..... 49/493.1
2,584,089 A * 1/1952 Hillenbrand et al. ..... 312/213
(Continued)

FOREIGN PATENT DOCUMENTS

DE 20015080 U 1/2001
DE 202006005548 U1 6/2006
(Continued)

OTHER PUBLICATIONS

Granting Decision RU 2010135406 dated Jan. 9, 2013.

*Primary Examiner* — Daniel J Troy
*Assistant Examiner* — Andres Gallego
(74) *Attorney, Agent, or Firm* — Nixon & Vanderhye P.C.

(57) ABSTRACT

A refrigeration device having a first component and a second component, wherein the first component has an elongated seal element in form of a hollow profile to thermally seal the first component against the second component. The seal element also has an elongated materially-rigid first seal base and an elongated materially-elastic first seal head that is attached to the first seal base. At least one open end of the seal element is closed off by a terminating element. The terminating element has a materially-rigid second seal base and a materially-elastic second seal head that is attached to the second seal base. The first seal base and the second seal base are joined to one another.

33 Claims, 3 Drawing Sheets

(51) Int. Cl.

| | |
|---|---|
| *F25D 23/02* | (2006.01) |
| *E06B 7/23* | (2006.01) |

(56) References Cited

U.S. PATENT DOCUMENTS

| | | | | |
|---|---|---|---|---|
| 2,606,424 | A * | 8/1952 | Ayres | 62/273 |
| 2,910,209 | A * | 10/1959 | Nelson | 220/378 |
| 3,254,503 | A * | 6/1966 | Rundell | 62/275 |
| 3,407,016 | A | 10/1968 | Kronenberger | |
| 4,248,017 | A * | 2/1981 | Micallef | 49/493.1 |
| 4,417,420 | A * | 11/1983 | Marsh | 49/482.1 |
| 5,111,617 | A * | 5/1992 | Saiga | 49/493.1 |
| 5,297,360 | A * | 3/1994 | Besore et al. | 49/484.1 |
| 5,581,950 | A * | 12/1996 | Nakamura | 49/475.1 |
| 5,581,951 | A * | 12/1996 | Ryan et al. | 49/498.1 |
| 5,702,533 | A * | 12/1997 | Mundt et al. | 118/733 |
| 6,290,314 | B1 * | 9/2001 | Kim | 312/407 |
| 2003/0075878 | A1 * | 4/2003 | Sehr et al. | 277/630 |
| 2003/0173748 | A1 | 9/2003 | Bormann et al. | |
| 2005/0138955 | A1 * | 6/2005 | Okuda et al. | 62/441 |
| 2008/0256875 | A1 * | 10/2008 | Narimatsu et al. | 49/475.1 |

FOREIGN PATENT DOCUMENTS

| | | | |
|---|---|---|---|
| EP | 0583984 | A | 2/1994 |
| EP | 1225404 | A3 | 7/2002 |
| FR | 2230242 | A | 12/1974 |
| JP | 63125453 | A | 5/1988 |
| JP | 06018156 | A | 1/1994 |
| JP | 10220958 | A | 8/1998 |
| JP | 2006010299 | A | 1/2006 |
| JP | 2006038437 | A | 2/2006 |
| JP | 2007047899 | A | 2/2007 |
| SU | 410221 | | 1/1974 |
| SU | 1120148 | A | 10/1984 |
| WO | WO 2008/135375 | A2 | 11/2008 |

* cited by examiner

REFRIGERATION DEVICE HAVING A SEAL ELEMENT IN THE FORM OF A HOLLOW PROFILE

BACKGROUND OF THE INVENTION

The invention relates to a refrigeration device with a first component having an elongated seal element in the form of a hollow profile for thermal sealing against the second component, with the seal element having a hollow profile featuring an elongated materially-rigid seal base and an elongated materially-elastic seal head attached thereto.

In refrigeration devices such as bottle storage cabinets, especially wine cabinets, at least two storage compartments with different cooling temperatures are normally present. In such cases the two storage compartments are separated from one another by an interior divider or a partition wall. To enable any remaining gap between the front face side of the dividing wall and the door of the refrigeration device to be thermally sealed, an elongated seal element in the form of a hollow profile is usually provided on the edge of the door facing towards the partition wall, i.e. uniform, i.e. being made from the same soft-elastic plastic material in its entirety. The seal effect between the seal element attached to the front edge of the partition wall is especially provided by the materially-elastic deformable, soft hollow profile part of the seal element being slightly compressed when the door is closed. This seals any edge gap between the inner wall of the door and the partition wall and thus ensures thermal sealing between the storage compartments to be cooled separately.

If this type of seal element in the form of a hollow profile has open ends this is frequently aesthetically unsatisfactory, particularly if the door includes a transparent window. If the ends of the elongated seal element in the form of a hollow profile are welded closed, this is likewise aesthetically unsatisfactory. In addition air cannot escape from the hollow profile of such a seal element, which can adversely effect sufficient compression of the hollow profile of the seal element by the closed door.

The sealing of the edge gap between partition wall and door can especially in the long edge area, i.e. in the vicinity of the ends of the hollow profile, i.e. where the door closes against the chassis of the refrigeration device or is hinged onto it, can be critical because of different compression forces of the door and/or because of different forms of inner contour of the edge gap. Thus for example the inner surface of the door facing towards the seal element in the form of a hollow profile can run unevenly, especially bent or curved over the entire length of the seal element. Particularly in the vicinity of the ends of the hollow-profile seal element the inner surface of the door can mostly be more or less heavily contoured. Frame elements are often present on the side edges of the door which can exhibit a different contouring compared to the viewing window of the door. Such frame elements of the door can sometimes even protrude inwards on the partition wall to slightly opposite the plane of the position of the door window. Because of the accompanying contour changes of the intermediate space between the edge of the partition wall and the door in the respective long side area and/or different compression forces of the door along the longitudinal extent of the edge of the partition wall, in practice the ends of the sealing element have previously been either set with a gap to the respective side edge of the door whereby the seal effect is reduced there in the edge area; or in the closing area of the door and/or in the hinged area of the door the free, open ends of the seal element in the form of a hollow profile are closed with the aid of glued-on soft elastic terminating caps of which the outer contour or profile form can be adapted in accordance with the respective gap conditions present in the edge area, i.e. in the area of the two long edges of the door. In practice the gluing-on of such a soft, flexible termination cap to the respective open end of the seal element in the form of a hollow profile can however be rendered more difficult since the plastic material of seal element and terminating cap is soft and yielding, which makes it more difficult to handle during manufacturing or assembly of the seal.

BRIEF SUMMARY OF THE INVENTION

The underlying object of the invention is to provide a refrigeration device with an elongated seal element in the form of a hollow profile for thermal sealing between the first component and a second component of which the respective open end can be provided in a more simple manner aesthetically attractively with a termination element having at the same time a sufficient sealing effect.

In accordance with the invention this object is achieved for a refrigeration device of the type mentioned at the start by at least one open end of the seal element in the form of a hollow profile being closed off by a terminating element which likewise has a materially-rigid seal base and a materially elastic seal head attached thereto, and by the materially-rigid seal bases of the terminating element and the sealing element being connected to each other.

The connection or coupling together, especially rigid connection or fixing between the materially-rigid seal base of the respective terminating element and the materially-rigid wheelbase of the seal element in the form of a hollow profile makes simpler manual assembly of a seal possible. The handling of seal element and respective terminating element is now simplified during their assembly. It is sufficient, from the non-visible rear side of the sealing element and of the respective terminating element, merely to couple together or to join together their materially-rigid seal bases in the joining area, while a fixed connection or fixing together in the joining area between the open face sides of the materially-elastic seal head of the seal element and of the terminating element can be omitted. Seen in the longitudinal direction, no continuous attachment or fixing between the open face sides of the elastic, i.e. flexible or deformable seal head of the seal element and of the terminating element is required any longer over the contact or joining zone. It is especially sufficient for the seal head of the terminating element to rest loosely with its open face side on the open face side of the sealing element or for the face sides of the seal head of the seal element and the terminating elements to largely butt flush against each other or rest against each other. This is because the rigidly continuously connected to one another i.e. joined materially-rigid or materially-hard seal bases of seal element and respectively attached terminating element form a mechanically stable carrier frame for the elastic seal heads of the seal element in the form of a hollow profile and the respective attached terminating element. This enables mechanical stresses, especially tensile forces which might act on a seal composed of the seal element and the respective terminating element attached to the end sides to be suitably taken up by the elastically-deformable seal head of the seal element and the respective attached terminating element. This is because they are taken up by the coupled-together, materially-rigid seal bases of the seal and of the terminating element such that they cannot have an impermissible effect or any effect at all on their elastic seal heads. An undesired pulling apart of the elastic material of the seal head of terminating element and seal element at their end-side point of contact or joining point is thus largely avoided. Thus the formation of a gap at the joining point between the face sides of the seal head of the seal element and the seal head of the respective terminating element is largely avoided. For coupling the terminating element to the seal element a fixed connection between their materially-rigid seal bases is sufficient, while the end-face sides of the elongated seal element and of the respective terminating element facing towards each other can remain loose, i.e. unconnected. In particular it is sufficient for the end-face sides of seal element and terminating element facing towards each other to be essentially flush in relation to each other.

This coupling together of the materially-rigid seal basis of the seal element and of the respective terminating element, viewed in the longitudinal direction, allows a largely continuously closed outer surface of the seal to be ensured over the respective joining point when viewed from the door of the refrigeration device. Because of their essentially smooth or uninterrupted, i.e. largely fully closed outer surface over the joining point, a seal manufactured in this way can also be kept clean in a simple and reliable manner. In addition, a uniform and thereby aesthetically favorable overall geometrical shape for the completed seal, consisting of the seal element and the respective terminating element attached to its end side is produced.

Gluing the materially-elastic seal heads of the seal element and of the respective terminating element to their end-face sides is not necessary, which avoids any contamination with adhesive of the visible outer surfaces of seal element and respective terminating element joined to its end-face side.

The coupling of the terminating element to the open end-face sides of the seal element to be closed in each case by attaching together the materially-rigid seal bases of seal element and terminating element is particularly useful since these seal bases are partly or completely covered by the seal heads on the rear side of the completed seal, i.e. on the side of the completed seal facing away from the outwards-curved hollow profile of the seal heads. This means that the respective coupling together of the seal bases of seal element and terminating element is largely invisible when the completed seal is viewed from the front.

In accordance with an advantageous development of the invention the first component is formed by a partition wall between two separately temperature-controlled compartments of an inner container of the refrigeration device. The second component is then especially formed by a door which closes off the two compartments. For sealing, the partition wall running between the compartments preferably bears an edge of the elongated seal element in the form of a hollow profile facing towards the door.

In accordance with an expedient development of the invention the materially-rigid sealing bases of the terminating element and of the seal element are coupled to one another via a plug-in connection, glued connection or another force-fit, form-fit and/or friction-fit connection. In addition to or independently of this they can if necessary also be rigidly connected via an adhesive connection to one another.

In accordance with an advantageous development of the invention the materially-rigid seal base of the respective terminating element is especially a web element which protrudes from the joining opening of the terminating element in the direction of the open end of the seal element in the form of a hollow profile to be closed off Expediently the materially-rigid seal base of the elongated seal element in the form of a hollow profile corresponding to this element has at its respective open end or continuously along its entire longitudinal extension a clamp-like, materially-rigid or materially-hard receiving rail. In this way a mechanically-stable push-in coupling is made possible between the materially-rigid web element of the terminating element and the materially-rigid, clamp-type receiving rail of the seal element, which can also be released again.

In accordance with a further development of the invention the seal head of the terminating element has in the area of its join opening a projecting inner sleeve part made from a soft elastic material. This inner sleeve part is especially formed onto the inner wall of the hollow profile-shaped seal head of the terminating element. If the terminating element is pushed completely into the assigned open end of the seal element then it's inner sleeve part lies in the hollow-profile-type seal head of the seal element such that the latter's inner wall lies on it. This inner sleeve part advantageously provides an additional internal visual screen. At the same time the inner sleeve part stabilizes the elastic seal head of the seal element in the form of a hollow profile from inside so that, in the area of the end-face sides abutting each other of the profile elements of the seal heads of the seal element and of the terminating element made from elastic and thereby yielding plastic material an essentially flush join is made possible. Any remaining gap between the hollow profile-shaped seal heads of seal element and respective terminating element is thus covered from within by this inner sleeve part at a type of visual screen. For a user of the refrigeration device looking at the seal from the front e.g. on the edge of a partition wall this means that there is not even any hole in the respective joining area of terminating element and seal elements but merely the outer wall of the inner sleeve part if the terminating element with its seal head does not lie flush on the seal head of the seal element on its end-face side. The inner sleeve part advantageously enables manufacturing tolerances in respect of the seal head geometries and seal head dimensions of the seal head and of the respective terminating element within a predetermined area of play which is delimited by the axial projection length of the inner sleeve projecting from the join opening to be compensated for and a visual screen still to be provided. It advantageously helps to form a continuously closed front edge of the seal formed by the seal element and the terminating element. A view into the inside of this seal is even blocked to the user of the refrigeration device in practical use if the materially-hard seal base of the terminating element comes lose slightly from the materially-rigid seal base of the seal element and were to move away from the end-face side of the seal element in an axial direction. This produces an aesthetically uniform geometrical shape along the entire longitudinal extent of the seal element with the terminating element attached to its end-face side in each case.

BRIEF DESCRIPTION OF THE DRAWINGS

The invention and its developments are explained in greater detail below with reference to drawings.

The drawing shows.

DETAILED DESCRIPTION OF EXEMPLARY EMBODIMENTS OF THE PRESENT INVENTION

Elements with the same function and mode of operation are provided with the same reference signs in each case in FIGS. 1 to 13 inclusive.

Figure 1:
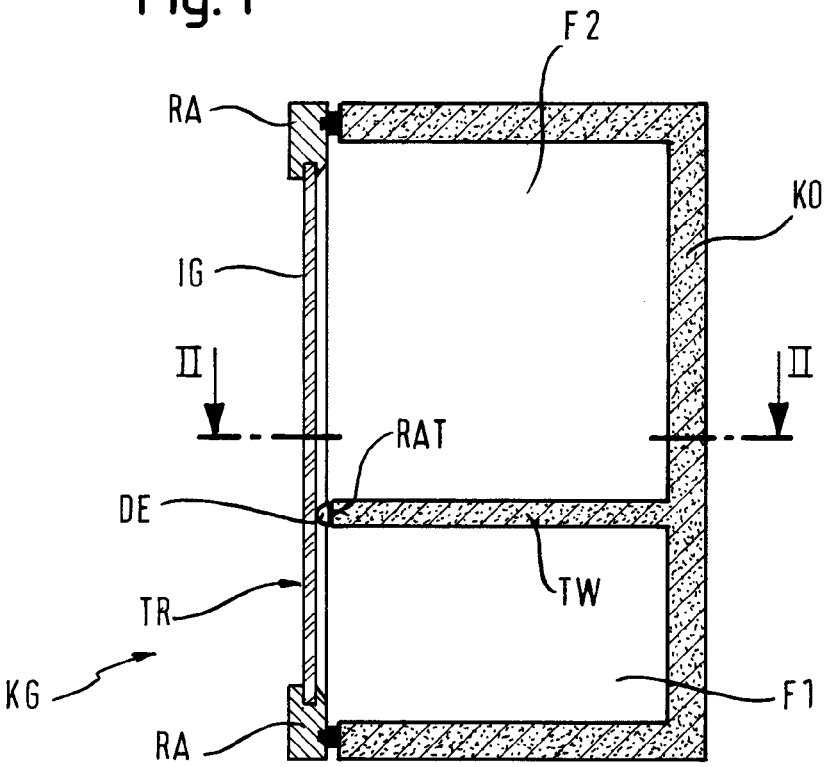
FIG. 1 in a schematic vertical cross-sectional diagram, an exemplary embodiment for an inventive refrigeration device, FIG. 2 in a schematic horizontal cross-sectional diagram, the refrigeration device depicted in FIG. 1 along the sectional plan II-II, FIG. 3 a front view of an elongated seal element in the form of a profile in the refrigeration device of FIGS. 1, 2, which is attached to the front edge of its partition wall and has terminating elements at its two ends which are joined in accordance with an advantageous embodiment variant of the invention, FIG. 4 a schematic cross-sectional diagram of the seal element depicted in FIG. 3 in the area of the plug-in connection of a terminating element, FIG. 5 a schematic overhead view of the elongated seal element in the form of a hollow profile from FIG. 3 with its two terminating elements plugged in at both ends, FIG. 6 a schematic longitudinal sectional diagram of the plug-in connection between a terminating element and an open end of the seal element in the form of a hollow profile from FIG. 5, FIG. 7 a schematic cross-sectional diagram of the plug-in connection between the terminating element and the open end section of the seal element from FIG. 6, FIGS. 8, 9, 10 perspective schematic diagrams of a terminating element on the respective end of the seal element of FIGS. 1 and 7, FIG. 11 a schematic cross-sectional diagram of the elongated seal element in the form of a hollow profile from FIG. 3 in the area of its end-face side terminating point without attached terminating element, FIG. 12 a schematic diagram shown in perspective of a front view of a completely assembled plug-in connection between the terminating element of FIGS. 8 to 10 inclusive and the seal element in the form of a hollow profile of FIGS. 1 to 7, inclusive and FIG. 13 a schematic diagram shown in a perspective of the completely assembled plug-in connection of FIG. 12 viewed from its rear side.

FIG. 1 shows a schematic diagram of a vertical section through a refrigeration device KG, which is constructed in accordance with an advantageous embodiment variant of the invention. The refrigeration device KG is preferably embodied as a bottle cabinet, especially as a wine bottle cabinet. Its carcass KO features two independently temperature-controlled inner compartments F1, F2 which are separated from one another by a horizontal partition wall TW, especially a so-called division plate. The partition wall TW thus forms an internal space divider for the interior of the carcass KO. The carcass KO and the partition wall TW between the two inner compartments F1, F2 to be thermally insulated from one another are preferably filled with a heat-insulating material such as polyurethane foam for example or another heat-insulating material. The two inner compartments F1, F2 held at different temperatures can be closed off by a common door. The door TR comprises a frame RA into which is let an insulating glass panel IG or other transparent window. The interior of the two inner compartments F1, F2 and also the partition wall TW between the two compartments is visible through the insulating glass panel IG. To suppress any exchange of air as far as possible between the compartments F1, F2 even in the gap area between the front edge RAT of the partition wall TW and the inner wall of the door TR in the closed state of the refrigeration device, an elongated seal element DE is provided between the inner wall of the door TR and the front edge or the front end face RAT of the partition wall TW.

Figure 2:
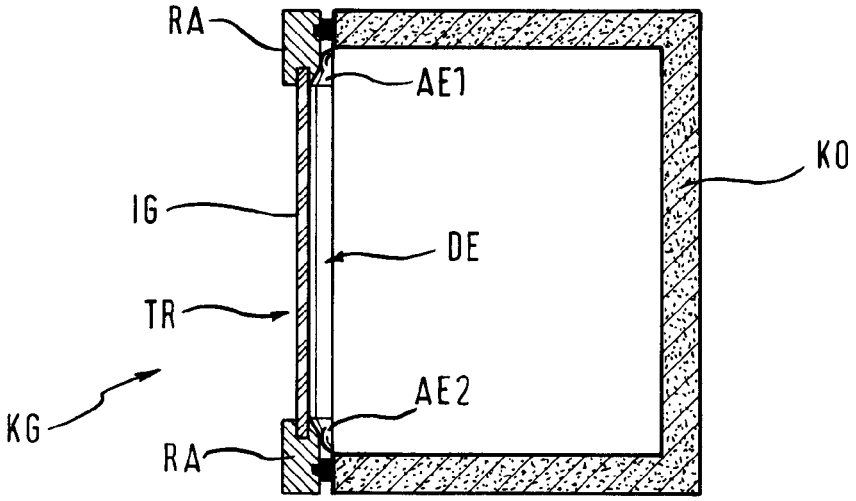
Figure 4:
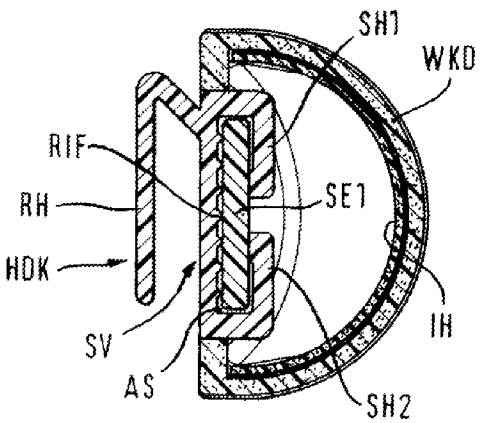
Figure 7:
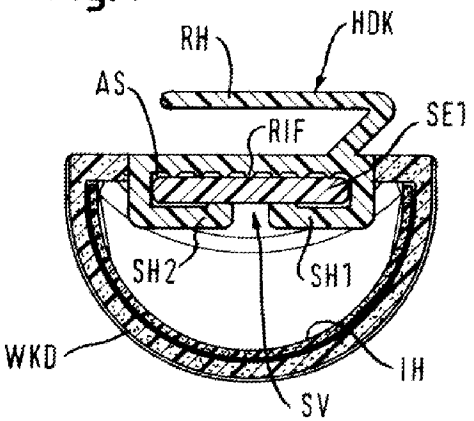
Figure 3:
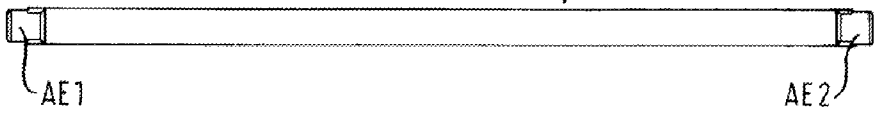
Figure 5:
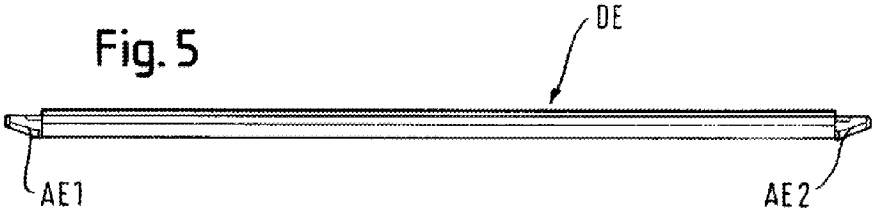
Figure 6:
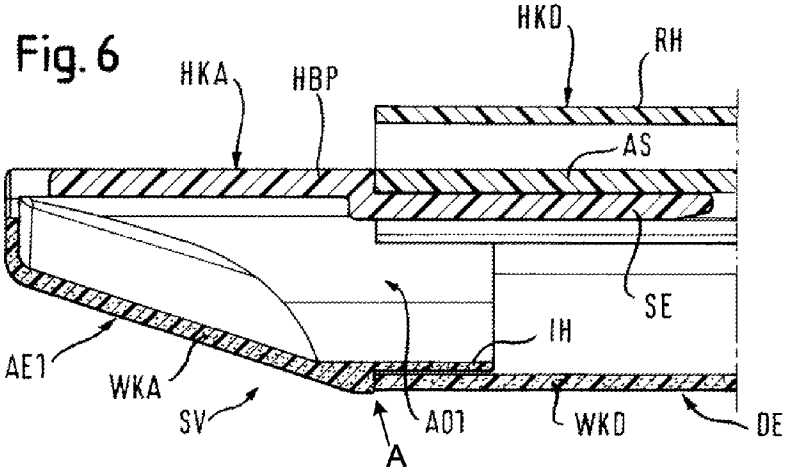
Figure 9:
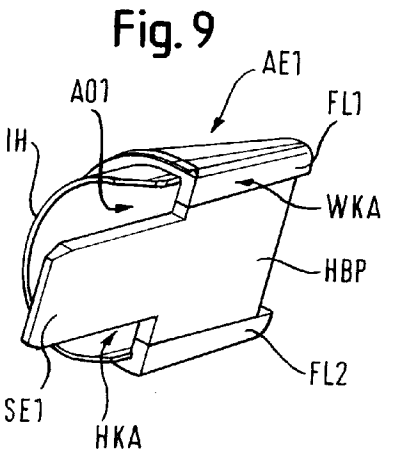
Figure 8:
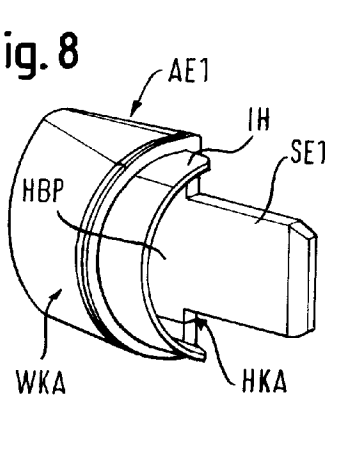
Figure 12:
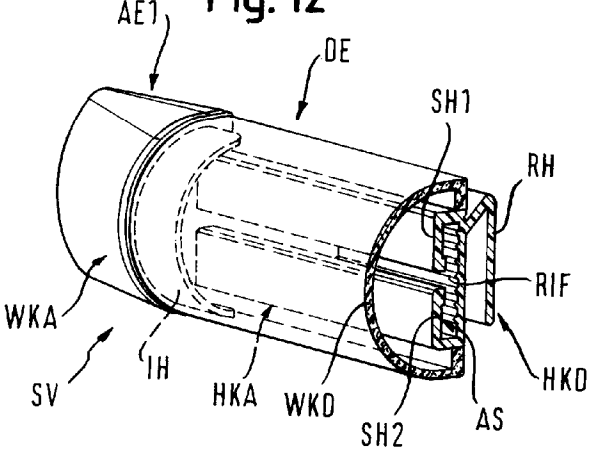
Figure 10:
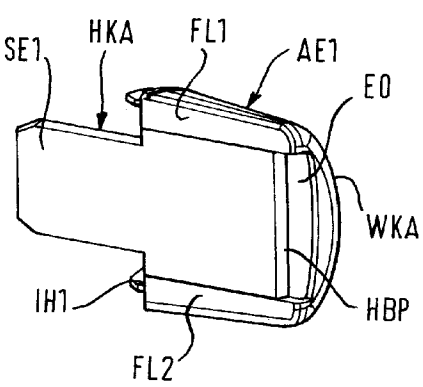

The horizontal sectional diagram depicted in FIG. 2 through the refrigeration device from FIG. 1 along the sectional plane II-II depicted in this figure shows that, at the two ends of the seal element DE in the area of the respective closing zone and/or hinge zone of the door TR in the area of the front long edges of the carcass KO, a terminating element AE1, AE2 is attached in each case. FIG. 3 shows in a front view, i.e. when looking towards the edge RAT of the partition wall, the completely assembled seal which comprises three parts, namely an elongated seal element DE in the form of a hollow profile and a respective terminating element AE1 or AE2 which is pushed on in each case along a gap section between the partition wall and the respective long profile element of the door frame RA onto the open end of the seal element DE there. FIG. 5 shows, when viewed from above, a schematic overhead view of the elongated seal element in the form of a hollow profile from FIG. 3 with its two terminating elements plugged into its two ends. In this case the respective terminating element is arranged largely flush with the axial longitudinal extent of the seal element.

Figure 11:
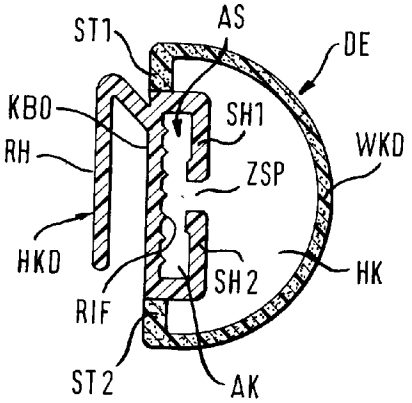
Figure 13:
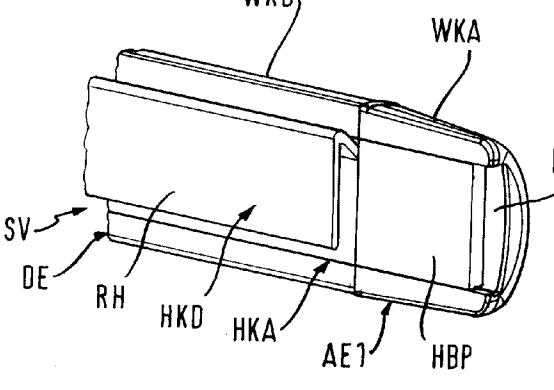

FIG. 11 shows a schematic cross-section, i.e. in a plane at right angles to the axial longitudinal extent of the seal element, the profile form of the elongated seal element DE. Its seal head WKD is formed by an approximately semicircular-shaped profile element which is formed over radial webs ST1, ST2 extending inwards onto a seal base HKD essentially embodied as a flat surface on its rear assembly side. The seal base HKD and the semicircular seal head WKD enclose a hollow chamber HK between them in this case. An elastically, especially plastically deformable or flexible soft plastic material is selected for the seal head WKD, while by contrast a more rigid, e.g. harder plastic material is used for the seal base HKD. Preferably the seal element in the form of a hollow profile is manufactured by means of extrusion from a harder thermoplastic elastomer for the seal base and a softer thermoplastic elastomer by contrast for the seal head. The seal base has on its rear side a latching hook RH which in the cross-sectional diagram depicted in FIG. 4 has the form of a "1" in mirror writing. The latching hook or latching web RH has an essentially flat rear surface which runs largely in parallel to the flat floor element KBO of the seal base HKD, onto the sides of which the semicircular-shaped profile element of the seal head WKD is flanged by the webs ST1, ST2 running radially. With the aid of the latching hook RH the seal element DE in the form of a hollow profile can be latched into an associated corresponding slot along the horizontal longitudinal course of the edge RAT. This has been omitted in FIGS. 1, 2 to simplify the diagrams. In this case the seal element DE is attached along the horizontal edge RAT running along the partition wall RT is such that the essentially semicircular-shaped oriented seal head WKD is facing towards the inner wall of the door TR. Because of the soft elastic or plastically-deformable, especially flexible plastic material for the seal head WKD, its profile element curved outwards in a concave shape is able to be deformed when the door TR is pushed i.e. closed elastically-sprung inwards onto the seal base HKD. With an opened door this semicircular-shaped profile element of the seal head WKD deforms because of its spring elasticity back into its original contour position. Because of the material rigidity of the seal base HKD this can be attached mechanically-stably along the horizontal course of the edge RAT of the partition wall TW. This especially facilitates manual assembly compared to a conventional seal element which merely has a soft elastic seal base and a soft elastic seal head formed onto it. The materially-hard or materially-rigid seal base HKD thus forms a stable carrier bar for the seal element DE so this can essentially be attached in a straight line along the longitudinal course of the edge RAT. The material rigidity of the seal base HKD especially prevents local sagging of the seal element DE during assembly which would otherwise make its assembly more difficult. After the attachment of the seal element DE to the edge RAT of the partition wall TW the material rigidity of the carrier rail of the seal base HKD viewed in more general terms ensures that a desired course for the seal element DE, preferably a horizontal lengthwise course along the edge RAT can be largely maintained in a stable manner.

The materially-rigid carrier rail of the seal base has two opposing clamping or tensioning arms SH1, SH2 on its side facing towards the hollow space HK. The respective clamping arm, such as SH1 for example, is composed in this case of a long section running at right angles to the floor plate KBO of the seal base HKD and an end section running horizontally thereto, i.e. essentially in parallel to the floor plate KBO of the seal base HKD. The two clamping arms SH1, SH2 lie in approximately the same positional plane above the floor plate KBO and opposite one another with a gap ZSP between their free ends. In this way an approximately rectangular retaining bracket is formed by the floor plate KBO and the two clamping arms SH1, SH2 overall when viewed in cross section. Here in the exemplary embodiment the seal element DE has this continuous rectangular clamp profile shape of its seal base HKD along its entire lengthwise extent. As an alternative however it can simply be sufficient for the materially-rigid carrier bar of the seal base to provide such a clamp-shaped receiving rail merely in one end section in the area of the two open ends of the seal element DE. A correspondingly contoured web element SE1 of the respective terminating element is plugged into this clamp-type receiving rail. This is illustrated by the cross-sectional diagrams depicted in FIG. 4 and FIG. 7, as well as the longitude cross section of FIG. 6 as an example for the terminating element AE1. The spatial geometrical form of the terminating element AE1 is shown here in different perspectives viewed from the front and from the rear in FIGS. 8, 9 and 10.

The respective terminating element such as AE1 (see FIGS. 8, 9, 10) is likewise embodied as a hollow profile element. Like the elongated seal element, it is composed of a materially-rigid or materially-hard carrier element HKA as a seal base and a materially-elastic seal head WKA attached thereto. A harder or more rigid plastic material is selected for the carrier element HKA than for the seal head WKA. Conversely this means that a softer plastic material is used for the seal head WKA of the terminating element AE1 than is used for the carrier element. The carrier element HKA is essentially embodied as a flat-surface plate. This has a rectangular base part or floor part HBP, to the long side edges of which in relation to the plug-in direction of the receiving part AE1 a hollow profile element of the seal head WKA curved outwards in a concave manner is attached via flush-mounted flange elements FL1, FL2 (see FIG. 9). The geometrical shape of the hollow profile body of the seal head WKA can advantageously be adapted variably to the inner contour of the door TR or, expressed in general terms, to the gap space between the edge RAT of the partition wall TW and the long-side profile element or frame RA respectively of the door TR. This means that even in the area of the side profile elements of the door TR any gap between the edge RAT of the partition wall TW and the door TR can be covered by the respective terminating elements to make an exact fit, i.e. largely as a form fit, and thereby thermally sealed. In the present exemplary embodiment the hollow profile element WKA of the terminating element AE1 features an approximately wedge-shaped geometrical shape narrowing or flattened off towards its free end. This is illustrated by the schematic longitudinal section depicted in FIG. 6. The hollow profile element WKA facing towards the inner wall of the door TR especially has this type of external contour so that an acute angle is enclosed with the edge RAT of the partition wall TW. Considered in simple terms the hollow profile element WKA is especially embodied as a cut-out cone base segment at right angles to the base surface of a cone. This means that it narrows starting at its joining opening AO1, which faces towards the open end of the seal head WKD of the elongated seal element DE to be closed off in each case, towards its free end. The terminating element AE1 thus has, in relation to its profile element WKA curved outwards, especially curved outwards in a concave manner, starting from its joining opening AO1 (see FIG. 9) through to its free end, a narrowing of its diameter or a material flattening. In the area of the joining opening AO1 the internal and external diameter of this profile element WKA essentially corresponds to the internal and external diameter of the profile element of the seal head WKD of the seal element DE to be closed off in the area of its respective open end. Expressed in general terms, in the adjoining area between seal element and terminating element, the geometrical shapes of their seal heads expediently largely match each other.

In addition the profile element WKA of the terminating element AE1 has an inner sleeve part IH which, on the inner wall of its curved section, is formed essentially concentrically and projects from its joining opening AO1 for a predeterminable axial length (related to the axial longitudinal extent of the seal element). This inner part sleeve is likewise formed from an elastic or flexible, soft plastic material. In particular the same elastic, flexible plastic material is used for it as is used for the hollow profile-type seal head. The inner sleeve part IH here in the exemplary embodiment has a contour which is approximately semicircular in shape viewed in cross-section. If necessary it can also have another circle sector-shaped contour (viewed in cross-section). Its outer radius is especially selected such that it is essentially corresponds to the inner radius of the semicircular-shaped seal head WKD of the seal element DE. The wall thickness of the profile element WKA of the terminating element AE1 is preferably selected in the area of the joining opening AO1 such that it is essentially corresponds to the wall thickness of the profile element of the seal head WKD of the seal element DE on its end-face side to be closed. This forms a substantially flush butt joint as shown at arrow A in FIG. 6.

The carrier plate HBP of the terminating element AE1 has a flat cube-shaped web element SE1 which projects from its joining opening AO1 in the plug-in direction to the respective open end of the seal element DE to be closed off. The web element SE1 corresponds in this case in respect of its external contour to the inner contour of the clip-type receiving rail or guide rail AS of the sealing element DE in the area of its end to be closed off at the end face. By contrast with the flat rectangular-shaped carrier part or floor part HBP of the terminating element AE1, it is attached into the inside of the hollow space of the profile element WKA offset in the height to its floor part HBP. The thickness of the floor part HBP in the radial direction, considered in relation to the semicircular shape in contour of the profile element, i.e. considered at right angles to the flat surface of the floor part, is preferably selected in accordance with the thickness or wall strength of the floor part KBO of the receiving bar AS of the seal element DE. Preferably the same rigid or hard plastic material is selected for the web element SE1 as is selected for the floor plate HPB of the terminating element AE1.

If the terminating element AE1 with its web element SE1 is now plugged into the clip-type receiving rail AS of the elongated carrier part HKD of the seal element DE, it will be retained there by the elastically-sprung clamp arms or tensioning levers SH1, SH2. The tensioning levers SH1, SH2 press in this case on the upper side of the web element SE1 facing in towards the hollow space HK of the seal head WKD. At their respective free end in each case they exert a pressure force on the web element SE1 in the direction of the floor part KBO of the clip-type receiving rail AS approximately at right angles to the flat upper side of the web element SE1. To increase the pressure effect, the ends of the tensioning levers SA1, SA2 have been formed thickened, especially lump-like. The web element SE1 is retained in this way in the clip-type receiving rail AS largely as a form fit, force fit and/or friction fit. To increase the friction fit in the exemplary embodiment, the internal surface of the floor part KBO of the receiving rail AS is especially provided with rifling RIF. FIGS. 4, 6, 7 and 12 illustrate that, with the terminating element AE1 plugged in, its inner sleeve part IH penetrates into the hollow profile of the seal head WKD of the seal element DE and rests there as an inner layer against the inner wall of the seal head WKD. Considered in reverse, the inner wall of the seal head WKD rests against the outer wall of the inner sleeve part IH essentially concentrically. The inner sleeve part IH thus forms a surrounding thin wall along the inner curvature of the profile part of the seal head WKD. It thus serves as a type of stabilizer for the outwards-curved profile part of the seal head WKD. Furthermore an observer looking at the seal element DE in the area of the respective termination point cannot see a "hole", i.e. look into the respective open end of the seal element DE, but looks at the inner sleeve which covers the hollow space between the inserted termination element and the seal element, even if the terminating element AE1 with its web element SE1 is not a fully inserted into the clamp-type receiving rail. Even if the respective terminating element and is not resting fully, i.e. flush with its end-face side abutting end on the end-face side abutting end of the open end of the seal element DE, the connecting or terminating area remains covered by the inner sleeve part IH along its projecting length. This enables reliable account to be taken of manufacturing tolerances of respective terminating element and seal element or subsequent shrinking processes of their soft and/or hard components in the area of the end-face sides of the terminating element and the assigned open end of the seal element. This is even possible if the terminating element is not completely introduced or plugged in over the entire protruding length of its web element into the clamp-type receiving rail, so that even then a largely closed outer surface is produced for the observer between the respective terminating element and the respective end area of the seal element. This also applies if loosening causes the end faces of the seal heads of seal element and terminating element to come away from each other again.

Since in the end face area of the terminating element AE1 the geometrical shape of its externally-curved profile part WKA as well as its carrier part is adapted to the terminating-side geometrical shape of the outwards-curved profile part of the seal head WKD as well as the floor plate of the clamp-type receiving rail AS of the seal element DE, a largely flush termination between the respective end-face side of the seal element DE and the terminating element AE1 plugged in there largely flush in relation to the axial longitudinal extension of the seal element is brought about. In such cases the end-face side of the outer wall of the seal head WKD of the seal element and the end-face side of the outer wall of the seal head WKA of the terminating element butt up against each other.

Naturally other further types of releasable mechanical connections and/or also adhesive connections are possible as well as this clamp-type plug-in connection between the web element SE1 and the receiving rail AS between the materially-rigid seal bases of the seal element and the terminating element, which allow a non-destructive coupling or decoupling of the respective terminating element to or from the assigned end of the seal element. Thus instead of a plug-in or clamped connection any other force-fit, form-fit and/or friction fit connection between the seal basis can be provided as hard components of the seal element and of the terminating element. In addition to or independently from this it can also possibly be expedient to only fix the materially-rigid seal bases of seal element and respective terminating element to each other by an adhesive connection. The gluing of the hard components of seal element and terminating elements remains invisible because it is covered by the seal heads of seal element and terminating element. This means that gluing of the soft components located in the field of view, i.e. soft-elastic seal heads of seal elements and terminating element, is not necessary. This means that contamination of those external surfaces of the completed seal with adhesive which is visible to the observer when looking at the front of the seal is avoided. If necessary the materially-rigid seal bases of the seal element and of the terminating element can also be permanently connected to each other by a non-releasable, mechanical and/or adhesive fixing or permanent connection.

In the completely assembled state here in the exemplary embodiment the materially-hard carrier part of the seal base of the respective terminating element is fully permanently connected to the materially-hard carrier part of the seal base of the seal element, since the two carrier parts—here in the exemplary embodiment especially by the clamp-type plug-in connection—are permanently coupled to each other. Expressed in general terms the seal bases of the respective terminating elements and of the seal elements designed as hard components are connected to each other. This means that a stable, through-connected carrier component is formed so that the elastic, especially materially-soft profile parts of the respective terminating element and of the seal element can be largely joined to fit flush against each other. In this case especially the protruding inner sleeve part of the respective terminating element inserts itself below the inner wall of the profile part of the seal head of the seal element as a lower layer. This causes a visual screen or an internal panel always to be provided along the longitudinal extent of the inner sleeve IH, even if the terminating element is not completely inserted along the length of the web element into the receiving rail of the seal element or has come loose in the longitudinal direction. Even if a terminating element—as here in the exemplary embodiment for example—were to come loose from its plug-in connection, a sufficient visual screen would largely remain through the covering of the inner sleeve part along its projecting length.

In the exemplary embodiment (see FIG. 9 for example) an elongated latching hook, as in the seal element of FIG. 11, is missing from the floor plate of the carrier part HKA of the terminating element AE1. If necessary it can be expedient to provide such a latching hook on the floor plate HBP as well. This also enables the terminating element to be latched at edge RAT of the partition wall in a corresponding manner to the seal element DE into a corresponding latching slot.

Naturally it is also possible to omit the elongated latching hook on the seal element and on the respective terminating element and to attach their seal bases by other attachment means to the edge RAT of the partition wall. I.e. the respective seal base can also be provided with a layer of adhesive and can be glued along the edge RAT.

Since both the respective terminating element and also the seal element have a hard component in the seal base and these hard components of terminating element and seal element can be latched together by a plug-in connection or are able to be coupled together with the aid of another force-fit, form-fit and/or friction-fit and/or adhesive connection, it is now no longer necessary to glue together the elastic profile parts of the seal heads, i.e. the soft components of the respective terminating element and of the seal element. This means that contamination by adhesive during assembly is no longer possible in the visible terminating area facing towards the door between the seal heads of the respective terminating elements and the open end of the seal element to be closed off. This means that the visible surfaces of terminating element and seal element can be kept clean. In particular a plug-in or clamped connection between the hard, rigid seal bases of terminating element and seal element advantageously enables the desired seal to be assembled in a simple manner. The open profile end of the seal element can be closed, i.e. covered by simple plugging in or clamping on of the respective terminating element. The respective terminating element can be simply adapted in respect of its geometrical shape to the given inner contour conditions between the edge of the partition wall and the inner wall of the door. A seal manufactured in this way enables a variable tolerance compensation between door and separator (division plate) to be provided. This allows the formation of drips/condensation through different temperatures in the two different temperature zones of the inner compartments of the refrigeration device to be prevented. In addition the seal is easy to clean. This is because it allows a largely flush termination between terminating element and assigned seal element end in the seal head area to be established. These advantages also emerge for alternate connection techniques, such as for force-fit, friction-fit, form-fit and/or adhesive couplings or fixings for example.

If the door of the refrigeration device is now closed and presses against the seal produced in this way, the outwards-curved circular profile-shaped seal head of the seal element and of the respective terminating element will be pressed together. So that the air present in the hollow space of their profile elements can escape, in the present exemplary embodiment an outlet opening EO is provided at the free end of the terminating element AE1 (see FIGS. 10, 13 for example) between the carrier plate HBP of the seal base HKA and the seal head in the form of a hollow profile WKA. Naturally it is also possible to provide one or more further outlet openings in the seal base along the longitudinal extent of the seal element. If necessary a breakthrough can also be provided in the carrier plate of the respective terminating element to enable air to escape towards the edge of the partition wall.

Here in the exemplary embodiment the web element SE1 of the terminating element AE1 forms a type of connector element which can be plugged into a corresponding socket-type receptacle in the end area of the respective open end of the seal element. Naturally it is also possible to produce such a plug-in connection by forming such a web element in the reverse manner at the end of a seal base of the seal element and then by the respective terminating element to be joined on having a corresponding receiving receptacle on its seal base. Instead of providing the inner sleeve part in the area of the joining opening of the terminating element, in addition or independently of this a corresponding inner sleeve part can be formed onto the respective open end of the seal head.

The completed seal preferably thus has three parts: An elongated seal element and two end caps as terminating elements. The end caps in this case are preferably embodied as identical parts, i.e. they can be either plugged into the left-hand or right-hand end of the seal element without the risk of confusion. It is thus sufficient to preferably plug these three parts into each other and fix them by a plug-in connection, especially a press fit. Both of the respective end cap and also the sealing element in this case have a hard component as its seal base and a soft component as its actual hollow chamber profile element. In this case, in the assembled state, the hard component in the seal base and the soft component in the respective hollow chamber profile of the seal element and of the respective terminating element are fully connected to each other.

The seal element DE can especially be produced by extrusion or injection molding. The same applies to the respective terminating element.

To summarize, a simpler manual assembly of a seal is made possible by the connection or coupling together, especially fixed connection or fixing, between the materially-rigid seal base of the respective terminating element and the materially-rigid seal base of the seal element in the form of a hollow profile in the area of its respective open end. The handling of seal element and respective terminating element is now simplified during their assembly. It is sufficient from the non-visible rear side of the seal element and of the respective terminating element, merely to couple together or join together their materially-rigid seal bases in the joining area, while a fixed connection for fixing together between the open face sides of the materially-elastic seal heads of the seal element and of the terminating element can be omitted in the joining area. Viewed in the longitudinal direction, a continuous connection or fixing over the contact or joining zone between the open face sides of the elastic, i.e. flexible or deformable, seal head of the seal element and of the terminating element is no longer required. It is especially sufficient for the seal head of the terminating element to loosely adjoin the open end-face side of the seal element or to butt or place the end face sides of the seal heads of the seal element and of the terminating element largely flush with one another. This is because the continuously connected, i.e. assembled, materially-rigid or materially-hard seal bases of seal element and respectively attached terminating element form a mechanically stable carrier frame or support frame for the elastic seal heads of the seal element in the form of a hollow profile and the respective terminating elements attached thereto. This enables mechanical stresses, especially tensile forces, which may act on the seal comprising the seal element and the respective terminating element attached to the end side of it, to be sufficiently absorbed by the elastically-deformable seal heads of the seal element and the respective terminating element attached thereto. This is because they are captured by the coupled-together, materially-rigid seal bases of the seal element and of the terminating element such that they cannot exert an impermissible effect or have no effect on their elastic seal heads. An undesired pulling apart of the elastic material of the seal heads of terminating element and seal element at their end-side point of contact or joining point is thus largely avoided. The formation of a gap at the joining point between the end-face sides of the seal head of the seal element and the seal head of the respective terminating element is thus largely avoided. For coupling of the termination element to the seal element a connection or coupling together between their materially-rigid seal bases is sufficient while the end-face sides of the elongated seal element and the respective terminating element facing towards each other can remain lose, i.e. unconnected. In particular it is sufficient for the head and base sides of the seal heads of seal element and terminating element facing towards each other to essentially be flush in relation to each other.

This coupling together of the materially-rigid seal bases of the seal element and of the respective terminating element, viewed in the longitudinal direction over the respective joining point, enables a largely fully-closed outer surface of the seal to be ensured viewed from the door of the refrigeration device. Because of its essentially smooth or uninterrupted, i.e. largely fully closed outer surface over the joining point, a seal manufactured in this way can also be kept clean in a simple and reliable manner. In addition a uniform and therefore aesthetically pleasing overall geometrical shape is produced for the completed seal consisting of the seal element and the respective terminating elements attached to each end.

It is not necessary to glue the materially-elastic seal heads of the seal element and of the respective terminating element on their end-face sides, which avoids any contamination by adhesive of the visible outer surfaces of the seal element and respective terminating element joined to its end-face side.

The coupling of the terminating element onto the open face side of the seal element to be closed in each case by fixing the materially-rigid seal bases of seal element and terminating element to each other is especially useful since the seal bases are arranged on the rear side of the completed seal, i.e. on the side of the completed seal facing away from the outwards-curved hollow profile of the seal heads and are covered partly or completely by the seal heads. This means that the respective coupling together of the seal bases of seal element and terminating element is largely invisible when the completed seal is viewed from the front.

It can be especially expedient to couple together the materially-rigid seal bases of the terminating element and the seal element via a plug-in connection, clamp connection or any other force-fit, form-fit and/or friction-fit connection. In addition or independently they can also be permanently connected to each other via an adhesive connection.

Preferably the materially-rigid seal base of the respective terminating element especially has a Web elements which projects out of the joint opening of the terminating element in the direction of the open end of the seal element in the form of a hollow profile to be closed. Expediently, corresponding to this web element, the materially-rigid seal base of the elongated seal element in the form of a hollow profile has at its respective open end or fully along its entire longitudinal extent, a materially-rigid or hard receiving rail which has the shape of a clamp when viewed in cross-section. In this way a mechanically-stable plug-in coupling is advantageously made possible between the materially-rigid web element of the terminating element and the materially-rigid clamp-type receiving rail of the seal element, which is also able to be released again.

It can be especially advantageous for the seal head of the terminating element to have a projecting inner sleeve part made from a soft-elastic material in the area of its joining opening. This inner sleeve part is especially formed onto the inner wall of the seal head in the form of a hollow profile of the terminating element. If the terminating element is completely pushed into the assigned open end of the seal element, its inner sleeve part preferably lies in the seal head of the seal element in the form of a hollow profile such that its inner wall lies against the latter. Advantageously an additional, internal visual screen is provided by this inner sleeve part. At the same time the inner sleeve part stabilizes the elastic seal head of the seal element in the form of a hollow profile from within, i.e. it effects support from within against the wall of the seal head of the seal element arranged outside so that in the area of the end-face sides butting against each other of the profile element of the seal heads of the seal element and of the terminating element made from elastic and thereby yielding plastic material an essentially flush join is made possible. Any remaining gap between the seal heads of seal element in the form of a hollow profile and respective terminating element are thus covered from within by this inner sleeve part as a type of visual screen. For a user of the refrigerating device looking from the front onto the seal, e.g. at the edge of a partition wall, this means that there is then no hole in the respective joining area between terminating element and seal element, but merely the outer wall of the inner sleeve part if the terminating element with its seal head is not resting flush on the end-face side against the seal head of the seal element. In an advantageous manner the inner sleeve part enables production tolerances in respect of the seal head geometries and seal head dimensions of the seal element and of the respective terminating element within a predetermined area of play which is delimited by the axial projection length of the inner sleeve part projecting from the joining opening to be compensated for and a visual screen still to be provided. In an advantageous manner it helps to provide a fully closed front of the seal formed overall by seal element and terminating element. The user of the refrigerating device is prevented from looking into the inside of this seal in practical use even if the materially-hard seal base of the terminating element come loose slightly from the materially-rigid seal base of the seal elements and were to move away from the end face side of the seal element in the axial direction. This produces an aesthetically uniform geometrical shape along the entire longitudinal extent of the seal element with the terminating element attached to its respective end side.

The invention claimed is:

1. A refrigeration device, comprising:

a first component; and a second component;

wherein the first component has an elongated seal element in the form of a hollow profile to thermally seal the first component against the second component;

wherein the seal element has an elongated materially-rigid first seal base and an elongated materially-elastic first seal head attached to the first seal base;

wherein at least one open end of the seal element is closed off by a terminating element;

wherein the terminating element has a materially-rigid second seal base and a materially-elastic second seal head attached to the second seal base; and wherein the first seal base and the second seal base are joined to one another; and wherein the first seal head and the second seal head contact each other at a head joint where an inserted portion of one of the first seal head or the second seal head inserts into the other of the first seal head or the second seal head such that the inserted portion contacts and follows an interior surface of the other of the first seal head or the second seal head.

2. The refrigeration device of claim 1, wherein the first component is formed by a partition wall between two separate temperature controlled compartments of an inner container.

3. The refrigeration device of claim 2, wherein the second component is formed by a door which seals the two compartments.

4. The refrigeration device of claim 3, wherein the partition wall running between the two compartments bears at least one of the first and second seal bases on an edge facing towards the door.

5. The refrigeration device of claim 1, wherein the inserted portion is an inner sleeve part made of a soft-elastic material.

6. The refrigeration device of claim 5, wherein the inner sleeve part is formed on to an inner wall of the second seal head.

7. The refrigeration device of claim 5, wherein the terminating element includes the inner sleeve part, the inner sleeve part being inserted into the first seal head such that the interior surface of the first seal head lies against the inner sleeve part.

8. The refrigeration device of claim 1, wherein the first seal base has at an open end a clamp-type receiving rail.

9. The refrigeration device of claim 8, wherein the clamp-type receiving rail has two opposing elastically-sprung clamping levers, which press on a respective upper side of an inserted web element that faces towards a hollow space of a respective one of the first and second seal heads.

10. The refrigeration device of claim 1, wherein an outer contour of the terminating element narrows from a joining opening of the terminating element towards a free end of the terminating element.

11. The refrigeration device of claim 10, wherein the terminating element, when viewed spatially, is essentially flattened off in the form of a wedge.

12. The refrigeration device of claim 1, wherein the first and second seal bases are coupled together via at least one of a plug-in connection, a force-fit connection, a form-fit connection and a friction-fit connection.

13. The refrigeration device of claim 1, wherein the first and second seal bases are coupled together via an adhesive connection.

14. The refrigeration device of claim 1, wherein the first and second seal heads adjoin each other loosely on respective open end-face sides.

15. The refrigeration device of claim 1, wherein the second seal base has a web element that projects from a joining opening of the terminating element in a direction of the open end of the seal element that is to be closed off.

16. The refrigeration device of claim 1, wherein, in an assembled state of the terminating element and the seal element, an inner hollow space of the second seal head communicates with an inner hollow space of the first seal head.

17. The refrigeration device of claim 1, wherein, in an assembled state of the terminating element and the seal element, the first and second seal heads largely rest flush against each other at respective open end-face sides.

18. The refrigeration device of claim 1, wherein, at a free end face side of the terminating element between the second seal base and the second seal head, an air outlet opening is provided through which air escapes when at least one of the seal element and the terminating element are pressed together.

19. The refrigeration device of claim 1, wherein the refrigeration device is a bottle storage cabinet.

20. The refrigeration device of claim 1, wherein an outer surface of the second seal head at a free end face side of the terminating element is defined as a first location, an outer surface of the second seal head where it contacts the first seal head is defined as a second location, and the second seal head of the terminating element is angled such that a distance from the first location to the first component is smaller than a distance from the second location to the first component.

21. The refrigeration device of claim 20, wherein, at the free end face side of the terminating element between the second seal base and the second seal head, an air outlet opening is provided through which air escapes when at least one of the seal element and the terminating element are pressed together.

22. The refrigeration device of claim 1, wherein the first seal head is a material that is less rigid than a material of the first seal base, and the second seal head is a material that is less rigid than a material of the second seal base.

23. A refrigeration device, comprising:

a first component; and a second component;

wherein the first component has an elongated seal element in the form of a hollow profile to thermally seal the first component against the second component;

wherein the seal element has an elongated materially-rigid first seal base and an elongated materially-elastic first seal head attached to the first seal base;

wherein at least one open end of the seal element is closed off by a terminating element;

wherein the terminating element has a materially-rigid second seal base and a materially-elastic second seal head attached to the second seal base;

wherein the first seal base and the second seal base are joined to one another; and wherein the second seal head abuts the first seal head in a butt joint at the open end of the seal element such that an exterior surface of the first seal head is substantially flush with an exterior surface of the second seal head.

24. The refrigeration device of claim 23, wherein the second seal head includes an inner sleeve part made of a soft-elastic material, the inner sleeve part bridging the butt joint, and the inner sleeve part is pressed against an inner wall of the first seal head at a location where the first seal head seals the first component against the second component.

25. A refrigeration device, comprising:

a first component;

a second component; and an elongated seal element having a hollow profile to thermally seal the first component against the second component, the seal element having an elongated materially-rigid first seal base, an elongated materially-elastic first seal head attached to the first seal base and having an open end, and a terminating element closing off the open end of the first seal head, the terminating element having a materially-rigid second seal base and a materially-elastic second seal head attached to the second seal base, wherein the first seal base and the second seal base are joined to one another; and the first seal head and the second seal head contact each other at a head joint where an inserted portion of one of the first seal head or the second seal head inserts into the other of the first seal head or the second seal head such that the inserted portion contacts and follows an interior surface of the other of the first seal head or the second seal head.

26. A refrigeration device, comprising:

a first component;

a second component; and an elongated seal element having a hollow profile to thermally seal the first component against the second component, the seal element having an elongated materially-rigid first seal base, an elongated materially-elastic first seal head attached to the first seal base and having an open end, and a terminating element closing off the open end of the first seal head, the terminating element having a materially-rigid second seal base and a materially-elastic second seal head attached to the second seal base, wherein the first seal base and the second seal base are joined to one another, and the second seal head abuts the first seal head in a butt joint at the open end of the seal element such that an exterior surface of the first seal head is substantially flush with an exterior surface of the second seal head.

27. The refrigeration device of claim 26, wherein the second seal head includes an inner sleeve part made of a soft-elastic material, the inner sleeve part bridging the butt joint, and the inner sleeve part is pressed against an inner wall of the first seal head at a location where the first seal head seals the first component against the second component.

28. A refrigeration device, comprising:

a partition wall; and a second component;

wherein the partition wall has provided thereon an elongated seal element in the form of a hollow profile to thermally seal the partition wall against the second component;

wherein the seal element has an elongated materially-rigid first seal base and an elongated materially-elastic first seal head attached to the first seal base, the first seal head being configured to seal against the second component;

wherein at least one open end of the seal element is closed off by a terminating element;

wherein the terminating element has a materially-rigid second seal base and a materially-elastic second seal head attached to the second seal base, the second seal head being configured to seal against the second component; and wherein the first seal base and the second seal base are joined to one another; and wherein the first seal head and the second seal head contact each other at a head joint where an inserted portion of one of the first seal head or the second seal head inserts into the other of the first seal head or the second seal head such that the inserted portion contacts and follows an interior surface of the other of the first seal head or the second seal head.

29. The refrigeration device of claim 28, wherein the partition wall is disposed between two separate temperature controlled compartments of an inner container.

30. The refrigeration device of claim 29, wherein the second component is formed by a door which seals the two compartments.

31. The refrigeration device of claim 30, wherein the partition wall running between the two compartments bears at least one of the first and second seal bases on an edge facing towards the door.

32. The refrigeration device of claim 28, wherein the inserted portion is an inner sleeve part made of a soft-elastic material.

33. The refrigeration device of claim 32, wherein the inner sleeve part is formed on to an inner wall of the second seal head.

* * * * *